US010603707B2

(12) United States Patent
Fujii et al.

(10) Patent No.: US 10,603,707 B2
(45) Date of Patent: Mar. 31, 2020

(54) PRESS-FORMING METHOD, METHOD OF MANUFACTURING COMPONENT WITH THE PRESS-FORMING METHOD AND COMPONENT MANUFACTURED WITH THE PRESS-FORMING METHOD

(71) Applicant: JFE STEEL CORPORATION, Tokyo (JP)

(72) Inventors: Yusuke Fujii, Tokyo (JP); Yuji Yamasaki, Tokyo (JP); Toyohisa Shinmiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 120 days.

(21) Appl. No.: 15/561,581

(22) PCT Filed: Jan. 29, 2016

(86) PCT No.: PCT/JP2016/052555
§ 371 (c)(1),
(2) Date: Sep. 26, 2017

(87) PCT Pub. No.: WO2016/157976
PCT Pub. Date: Oct. 6, 2016

(65) Prior Publication Data

US 2018/0085811 A1 Mar. 29, 2018

(30) Foreign Application Priority Data

Mar. 31, 2015 (WO) ..... PCT/JP2015/060113

(51) Int. Cl.
*B21D 22/26* (2006.01)
*B21D 24/00* (2006.01)

(52) U.S. Cl.
CPC ..... *B21D 22/26* (2013.01); *B21D 24/005* (2013.01)

(58) Field of Classification Search
CPC ..... B21D 22/02; B21D 22/20; B21D 22/21; B21D 22/26; B21D 22/30; B21D 24/005; B21D 35/001
See application file for complete search history.

(56) References Cited

U.S. PATENT DOCUMENTS 9,266,162 B2 * 2/2016 Tanaka ..... B21D 22/02
2013/0239645 A1 9/2013 Tanaka et al.
(Continued)

FOREIGN PATENT DOCUMENTS

JP S59-076625 A 5/1984
JP H05-44322 U 6/1993
(Continued)

OTHER PUBLICATIONS

Translation; JP 2007-190588A, Aug. 2007.*
(Continued)

*Primary Examiner* — Edward T Tolan
(74) *Attorney, Agent, or Firm* — Oliff PLC

(57) ABSTRACT

A press-forming method for a component having a hat-shaped or U-shaped cross section and comprising a curved portion curved in a widthwise direction along with a longitudinal direction and straight side portions connecting to both ends of the curved portion from a sheet-shaped blank, wherein the blank is drawn to a hat-shaped or U-shaped cross section through a hat-shaped cross-sectional form having a top portion, vertical wall portions connecting at their upper end parts to both end parts of the top portion through fillet portions, and flange portions connecting at their internal end parts to the lower end parts of the vertical wall portions through fillet portions, and a material movement in the flange portion of the curved portion is caused in the drawing to mitigate tensile deformation or compression
(Continued)

deformation in the circumferential direction generated in the flange portion of the curved portion.

22 Claims, 6 Drawing Sheets

(56) References Cited

U.S. PATENT DOCUMENTS

| | | | | |
|---|---|---|---|---|
| 2015/0336619 | A1 | 11/2015 | Tanaka et al. | |
| 2017/0028455 | A1* | 2/2017 | Fujii | B21D 22/26 |

FOREIGN PATENT DOCUMENTS

| | | | | | |
|---|---|---|---|---|---|
| JP | 2005-186154 | A | | 7/2005 | |
| JP | 2007-190588 | A | * | 8/2007 | B21D 22/26 |
| JP | 2009-262168 | A | * | 11/2009 | B21D 22/26 |
| JP | 2010-064138 | A | | 3/2010 | |
| JP | 2010-227995 | A | | 10/2010 | |
| JP | 2013-27912 | A | | 2/2013 | |
| JP | 2014-039957 | A | | 3/2014 | |
| JP | 2014-240078 | A | | 12/2014 | |
| JP | 2015-186154 | A | | 10/2015 | |
| WO | 2012/070623 | A1 | | 5/2012 | |
| WO | 2014/106932 | A1 | | 7/2014 | |

OTHER PUBLICATIONS

Aug. 28, 2018 Office Action issued in Chinese Patent Application No. 201680017285.7.

Mar. 22, 2016 Search Report issued in International Patent Application No. PCT/JP2016/052555.

Jun. 29, 2017 Office Action issued in Japanese Patent Application No. 2016-524546.

Mar. 27, 2018 Search Report issued in European Patent Application No. 16771860.0.

Apr. 29, 2019 Office Action issued in Chinese Applicatio No. 201680017285.7.

Oct. 22, 2018 Office Action issued in Korean Patent Application No. 2017-7026798.

* cited by examiner

PRESS-FORMING METHOD, METHOD OF MANUFACTURING COMPONENT WITH THE PRESS-FORMING METHOD AND COMPONENT MANUFACTURED WITH THE PRESS-FORMING METHOD

TECHNICAL FIELD

This invention relates to a press-forming method for a component having a hat-shaped or U-shaped cross-section and curved in a widthwise direction along with a longitudinal direction, and more particularly to a press-forming method suppressing generations of cracks due to stretch flanging deformation and wrinkles due to shrink flanging deformation. Also, the invention relates to a component manufactured by using the press-forming method as a press-formed product having a hat-shaped or U-shaped cross section and curved in a widthwise direction along with a longitudinal direction.

RELATED ART

A higher-strength metal sheet has been recently demanded in order to establish collision safety of an automobile and weight reduction of an automobile body. However, as the tensile strength is increased, the metal sheet tends to decrease a ductility largely associated with a press formability. To this end, there is a tendency that bend forming (bending) or draw forming (drawing) is frequently used instead of bulging in which a ductility of a raw material largely affects the formability.

In the drawing, a blank of a metal sheet as a material to be formed into a component is first mounted onto a punch and a blank holder. A die is moved downward from above the blank to hold the blank between the die and the blank holder, and then the blank is curved by crowding the punch into the die to apply a proper tension to the blank. In this case, a material (a part of the blank) is largely drawn into a gap between the punch and the die to form a vertical wall portion of a component because the blank is held between the die and the blank holder. Therefore, the formation of the vertical wall portion becomes easy even in a material having a poor ductility. Also, since an out-of-plane deformation of the blank (wrinkling) is suppressed by the die and the blank holder, tension applied to the material drawn into the gap for the formation of the vertical wall portion is easily adjusted and hence there is a merit that a component of a complicated form can be easily formed.

On the other hand, when the component of a complicated form is manufactured by the drawing, there is an issue that cracks or wrinkles are generated at an end part of the blank in a position corresponding to a flange portion, which is likely to become a problem particularly in the manufacture of a component PT having a curved portion C curved in a widthwise direction along with a longitudinal direction and straight side portions S connecting to the both ends of the curved portion C as shown by a perspective view in FIG. 1 and by a plan view in FIG. 2.

FIG. 3 shows a cross-sectional form of the component PT shown in FIG. 1 and FIG. 2. The illustrated component has a hat-shaped cross-sectional form comprising a top portion T in the center of the widthwise direction, vertical wall portions W connecting at their upper end parts to both end parts of the top portion T through punch shoulder fillet portions P (R surface portions), and flange portions F connecting at their internal end parts to lower end parts of the vertical wall portions W through die shoulder fillet portions D (R surface portions) as well as a substantially L-shaped plane form comprising a curved portion C curved in a widthwise direction along with a longitudinal direction and straight side portions S connecting to both end parts of the curved portion C.

FIG. 4 is a sectional view illustrating an example of a usual die set for drawing such a component. The die set is provided with a lower die 3 comprising a blank holder 1 disposed in a position corresponding to the flange portions of the blank and a punch 2 liftably disposed in a through-hole formed in a central part of the blank holder 1, and an upper die 5 comprising a die member 4 having a concave portion capable of housing an upper portion of the punch 2. After the die set is installed in a press machine and the blank holder 1 is elastically held at the same height as the punch 2 by, for example, cushion pins 6 of the press machine, a blank is mounted onto the punch 2 and the blank holder 1. When the upper die 5 is moved downward to descent the die member 4 from above the blank, the die member 4 moves the blank and the blank holder 1 downward while holding the flange portions on the both sides of the blank between the die member 4 and the blank holder 1, whereby the punch 2 relatively pushes the middle portion of the blank into the concave portion of the die member 4 while applying a proper tension to the middle portion to thereby draw the component PT from the sheet-shaped blank.

When the top portion T, vertical wall portions W, flange portions F and the like of the component PT are curved in the widthwise direction of the component PT along with the longitudinal direction of the component PT as shown in FIG. 1, a material being a part of the blank is moved between the die member 4 and the blank holder 1 during the drawing, whereby they are subjected to a deformation EF stretching in a circumferential direction in the inside of the curved portion C (stretch flanging deformation) and a deformation CF inversely compressing in the outside of the curved portion C (shrink flanging deformation) due to excess and deficiency of linear length. When the stretch flanging deformation EF exceeding the ductility of the material is caused in the vicinity of the end part of the blank, cracks are generated, while when the shrink flanging deformation CF exceeding a buckling strength of the material is caused, wrinkles are generated, which comes into problems in the higher-strength metal sheets.

As a method for suppressing the wrinkles due to the shrink flanging deformation is known a method of dispersing the shrink flanging deformation as described in Patent Document 1. As a method for suppressing the cracks due to the stretch flanging deformation are known a method of dispersing the stretch flanging deformation as described in Patent Document 2 and a method of mitigating the stretch flanging deformation by moving the material of the top portion toward the vertical wall portion.

PRIOR ART DOCUMENTS

Patent Documents

Patent Document 1: JP-A-2010-227995
Patent Document 2: JP-A-2014-039957
Patent Document 3: WO2014/106932 A1

SUMMARY OF THE INVENTION

Task to be Solved by the Invention

As the strength of the metal sheet becomes higher, stress caused with respect to the deformation amount is increased, and hence stress exceeding the buckling strength of the metal sheet is easily caused to generate larger wrinkles. Also, as the strength of the metal sheet becomes higher, the wrinkle strength is increased, so that the method of dispersing the wrinkles as described in Patent Document 1 cannot be said to be a sufficient countermeasure. Further, the ductility in the end part of the blank is decreased in the higher-strength metal sheet, so that the prevention of cracks by the dispersion of stretch flanging deformation as described in Patent Document 2 is critical.

When the high-strength metal sheet is press-formed into a component curved in the widthwise direction along with the longitudinal direction as mentioned above, it is necessary to mitigate the generation of shrink flanging deformation and stretch flanging deformation themselves in order to suppress wrinkles due to the shrink flanging deformation and cracks due to the stretch flanging deformation. However, when the material is improperly moved, shape defects such as winkles and so on are caused in another site such as the top portion or the like, so that it is necessary to move the material without causing excess and deficiency thereof in the whole of the component.

Solution for Task

The press-forming method according to the invention advantageously solving the above problem is a method for press-forming a component having a hat-shaped or U-shaped cross section and comprising a curved portion curved in a widthwise direction along with a longitudinal direction and straight side portions connecting to the both ends of the curved portion from a sheet-shaped blank, characterized in that the blank is drawn to a hat-shaped or U-shaped cross section through a hat-shaped cross-sectional form comprising a top portion, vertical wall portions connecting at their upper end parts to both end parts of the top portion through fillet portions, and flange portions connecting at their internal end parts to the lower end parts of the vertical wall portions through fillet portions, and a material movement in the flange portion of the curved portion is caused in the drawing to mitigate tensile deformation or compression deformation in the circumferential direction generated in the flange portion of the curved portion.

In the press-forming method according to the invention, in order to cause the material movement in the flange portion of the curved portion for mitigating the circumferential tensile deformation or compression deformation generated in the flange portion of the curved portion, it is preferable to set a balance position of the material flowed in the straight side portion to the vertical wall portion on the side of the stretch flanging deformation in the curved portion or the fillet portion between the vertical wall portion and the flange portion and to increase the material flowed from the side of the shrink flanging deformation in the straight side portions to an extent exceeding the top portion (material movement pattern MA).

In the press-forming method according to the invention, in order to cause the material movement in the flange portion of the curved portion for mitigating the circumferential tensile deformation or compression deformation generated in the flange portion of the curved portion, it is preferable to set a balance position of the material flowed in the curved portion to the vertical wall portion on the side of the shrink flanging deformation or the fillet portion between the vertical wall portion and the flange portion and to suppress the material flowed from the side of the shrink flanging portion in the curved portion and increase the material flowed from the side of the stretch flanging deformation to an extent exceeding the top portion (material movement pattern MB).

A method of manufacturing a component according to the invention is characterized in that a sheet-shaped blank is drawn into a component of a preliminary shape having a hat-shaped or U-shaped cross section and curved in a widthwise direction along with a longitudinal direction by using the aforementioned press-forming method according to the invention, and the component of the preliminary shape is subjected to at least one of a restriking for rendering a bending radius of the fillet portions into a predetermined radius and a trimming for rendering a contour shape thereof into a predetermined shape to manufacture a component having a hat-shaped or U-shaped cross section and curved in a widthwise along with a longitudinal direction.

The component according to the invention is a component having a hat-shaped or U-shaped cross section and curved in a widthwise direction along with a longitudinal direction, characterized in that a sheet-shaped blank is drawn by using the aforementioned press-forming method according to the invention and formed into a predetermined shape by using at least one of a restriking for rendering a bending radius of the fillet portions into a predetermined radius and a trimming for rendering a contour shape thereof.

Effect of the Invention

In the press-forming method according to the invention, when a component having a hat-shaped or U-shaped cross section and comprising a curved portion curved in a widthwise direction along with a longitudinal direction and straight side portions connecting to the both ends of the curved portion is press-formed from a sheet-shaped blank, the blank is subjected to a drawing into a hat-shaped or U-shaped cross section through a hat-shaped cross-sectional form comprising a top portion, vertical wall portions connecting at their upper end parts to both end parts of the top portion through fillet portions, and flange portions connecting at their internal end parts to the lower end parts of the vertical wall portions through fillet portions, and a material movement is caused in the flange portion of the curved portion for mitigating a tensile deformation or a compression deformation in a circumferential direction generated in the flange portion of the curved portion, so that one or both of the generation of winkles due to the shrink flanging deformation and the generation of cracks due to the stretch flanging deformation can be suppressed.

In the press-forming method according to the invention, it is preferable to use a metal sheet having a tensile strength of 440-1470 MPa as a blank. In this case, it is possible to suppress one or both of the occurrence of wrinkles due to the shrink flanging deformation and the occurrence of cracks due to the stretch flanging deformation in the press-forming of a component made of a high-strength metal sheet.

EMBODIMENTS FOR CARRYING OUT THE INVENTION

Figure 1:
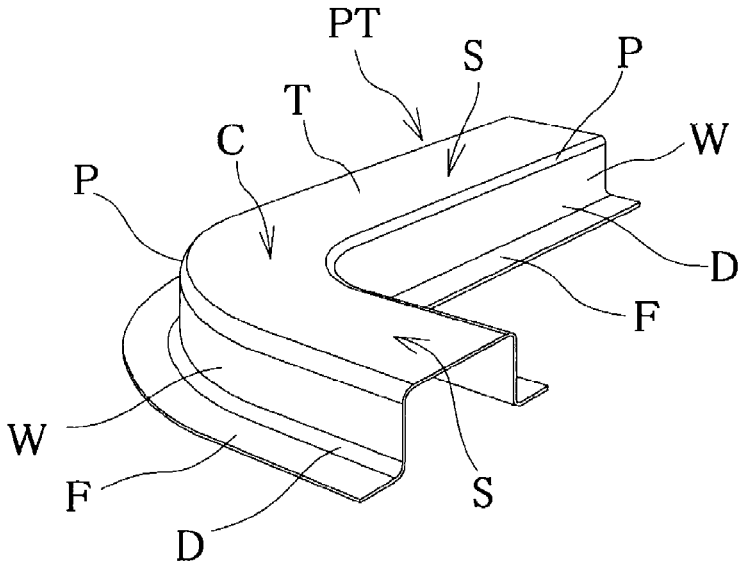
FIG. 1 is a perspective view illustrating a component comprising a curved portion curved in a widthwise direction along with a longitudinal direction and straight side portions connecting to both ends of the curved portion.
Figure 2:
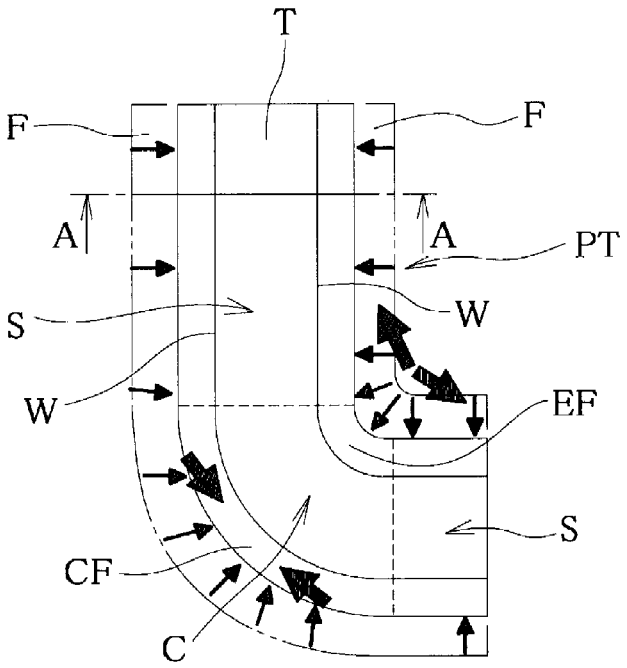
FIG. 2 is a plane view illustrating a component shown in FIG. 1 comprising a curved portion curved in a widthwise direction along with a longitudinal direction and straight side portions connecting to both ends of the curved portion.
Figure 3:
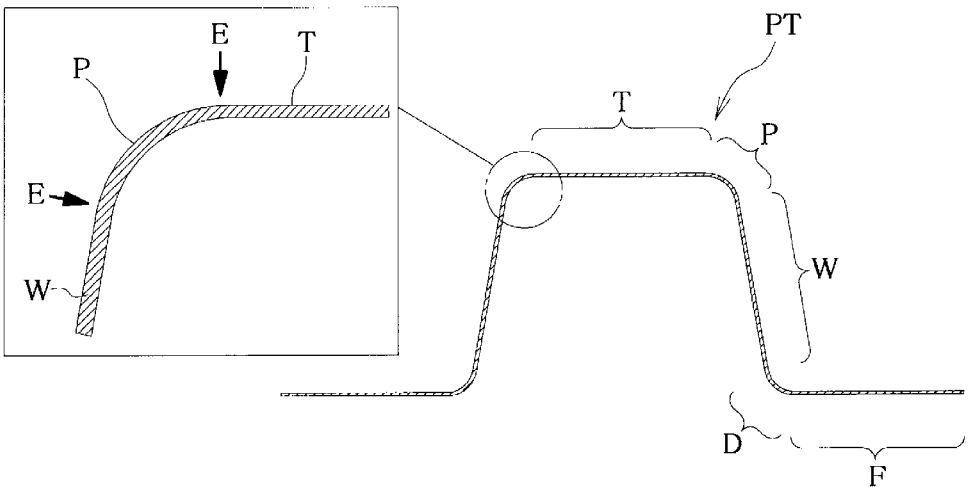
FIG. 3 is a cross-sectional view taken along with a line A-A of a component shown in FIGS. 1 and 2.
Figure 4:
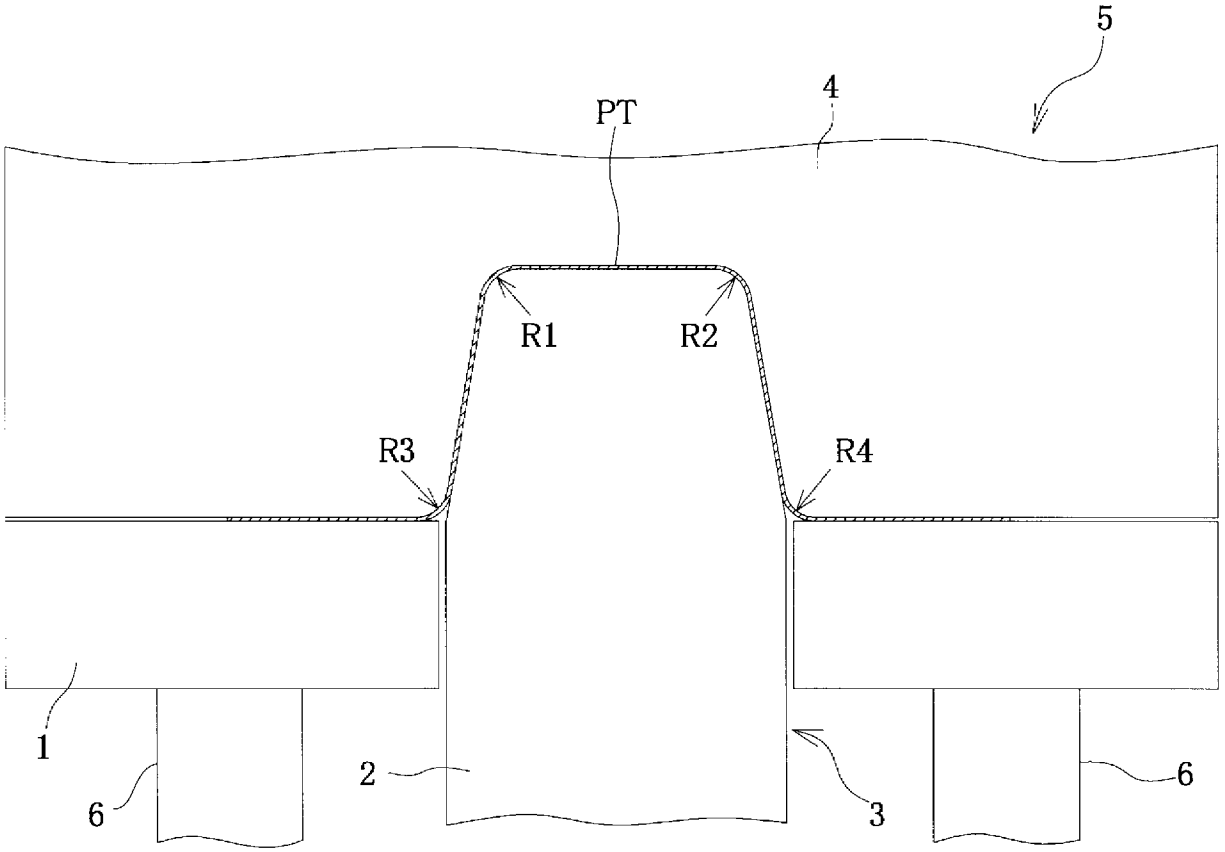
FIG. 4 is a sectional view illustrating a structure of a die set for drawing a component comprising a curved portion curved in a widthwise direction along with a longitudinal direction and straight side portions connecting to both ends of the curved portion.
Figure 5:
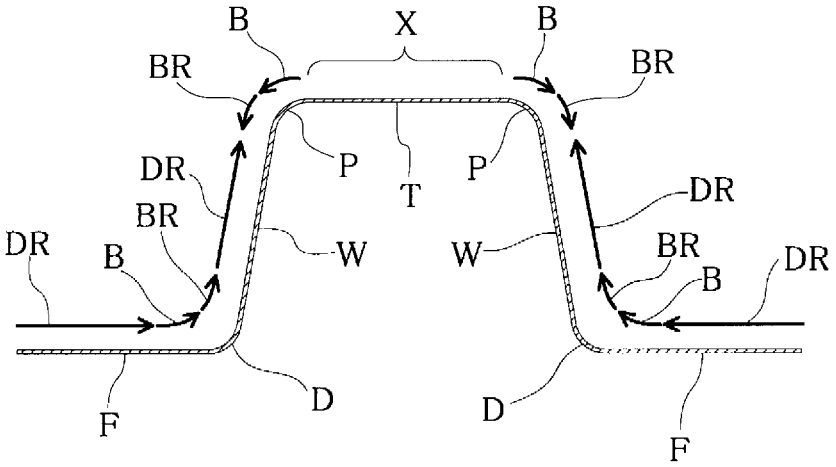
FIG. 5 is a sectional view illustrating a material movement in the conventional drawing.

An embodiment of the invention will be described in detail by means of an example with reference to the drawings. When a sheet-shaped blank is drawn into a component as shown in FIGS. 1-3 with a die set as shown in FIG. 4, a hat shape as shown in FIG. 5 is often formed in the conventional method by preferentially moving a material of the blank from a flange portion F to a vertical wall portion W, in which the material flowed from the top portion T to the vertical wall portion W is small as compared to the material flowed from the flange portion F.

This is due to the fact that the die set is designed so as to cause a balance of tension in the top portion P. When the material passes through a shoulder portion of a punch 2 forming a punch shoulder fillet portion P (portions having bending radii R1 and R2) and a shoulder portion of a die member 4 forming a die shoulder fillet portion D (portions having bending radii R3 and R4), respectively, as the punch shoulder fillet portion P (R surface portion) is shown on the left side of FIG. 3 by an enlarged scale, two R-stop positions E are existent in the shoulder of the punch 2 and die member 4, and the material is subjected to resistances (bending and unbending resistances) associated with bending deformation B and unbending deformation BR at these R-stop positions E as shown in FIG. 5.

Also, the material is subjected to a friction resistance from the shoulder portion of the punch 2 at a position of contacting the punch shoulder fillet portion P with the punch shoulder. The material passing through a portion forming the flange portion F or a portion forming the vertical wall portion W is subjected to an inflow resistance DR due to a friction caused by contacting with any one of the blank holder 1, the punch 2, and the die member 4 as shown in FIG. 5. When the die set has a bead shape, an emboss shape or the like, a resisting force deforming the material is caused along with such a shape. Further, if a shrink flanging deformation occurs in the flange portion F, shrink deformation is generated when the material flows from the flange portion F to the vertical wall portion W, so that the inflow resistance is increased. Since a position X balancing these resistances exists on the top portion T, the material flowed from the top portion T is small, and hence the material is moved preferentially from the flange portion F to the vertical wall portion W.

The inventors have got an idea that the material can be moved so as to mitigate the cracks due to the stretch flanging deformation and/or the wrinkles due to the shrink flanging deformation by changing the tension balance position X and made studies thereon. As a result, it has been found out that the balance position X can be freely determined by defining the shape of the die set and/or the friction resistance so that F1 and F2 are equal, wherein F1 is a total amount of the resistances on one hand with respect to a certain point and F2 is a total amount of resistances on the other hand.

Figure 6:
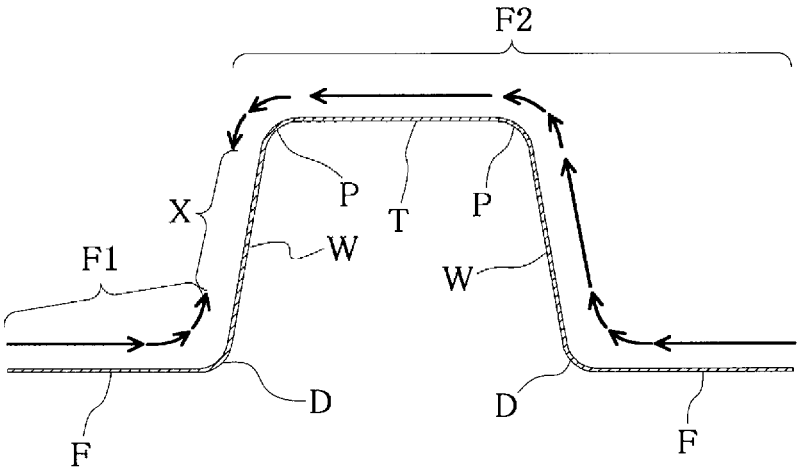
FIG. 6 is a sectional view illustrating a material movement state in a drawing by an embodiment of the drawing method according to the invention.

FIG. 6 is a sectional view illustrating a material movement state in the drawing by an embodiment of the drawing method according to the invention. As shown in FIG. 6, when a component having a hat-shaped or U-shaped cross section and comprising a curved portion C curved in a widthwise direction along with a longitudinal direction and straight side portions S connecting to the both ends of the curved portion as shown in FIG. 3 is press-formed from a sheet-shaped blank, the following method can be used for moving a balance position X from the top portion T according to the embodiment of the drawing method.

In the drawing method according to the embodiment, when a component having a hat-shaped or U-shaped cross section and comprising a curved portion C curved in a widthwise direction along with a longitudinal direction and straight side portions S connecting to the both ends of the curved portion as shown in FIG. 3 is press-formed, for example, by using a die set having a structure shown in FIG. 4, it is possible to decrease the bending and unbending resistances by increasing a bending radius, so that the balance position X can be easily moved from the top portion T by setting bending radii R1 and R2 in the shoulder portions of the punch 2 to 1.1-10 times of a bending radius R3 of the shoulder portion of the die member 4 positioned at the F1 side shown on the left side of FIG. 6 or on the left side of FIG. 4.

Further, the balance position X is moved toward the vertical wall portion W by using a method of decreasing an inflow resistance at the F2 side on the right side of FIG. 6 or a method of increasing an inflow resistance from the flange portion F at the F1 side on the left side of FIG. 6. As the method of decreasing the inflow resistance at the F2 side, there are a method wherein a bending radius R4 in the shoulder portion of the die member 4 positioned at the F2 side on the right side of FIG. 6 or on the right side of FIG. 4 is set to 1.1-10 times of the bending radius R3 in the shoulder portion of the die member 4 positioned on the F1 side of the left side in FIG. 6 or on the left side in FIG. 4, a method of decreasing the friction resistance by weakly holding the flange portion F at the F2 side on the right side of FIG. 6 with the blank holder 1 and the die member 4, and so on.

On the other hand, as the method of increasing the inflow resistance at the F1 side, there are a method wherein beads and/or embosses (not shown) formed in the blank holder 1 and/or the die member 4, i.e. beads and/or embosses formed in the flange portion F at the F1 side on the left side of FIG. 6 have a bending radius smaller than that of beads and/or embosses formed in the flange portion F at the F2 side on the right side of FIG. 6, a method wherein beads and/or embosses (not shown) are formed only in a portion of the blank holder 1 and/or the die member 4 holding the flange portion F on the F1 side on the left side of FIG. 6, a method of generating shrink resistance by curving the vertical wall portion W at the balance position X in a direction perpendicular to the wall surface of the vertical wall portion W to intentionally cause shrink flanging deformation in the flange portion F, a method of increasing the friction resistance by strongly holding the flange portion F at the F1 side with the blank holder 1 and the die member 4, and so on. The balance position X can be moved more easily by using the above methods in combination.

The reason why the bending radius is preferable to be set to 1.1-10 times is due to the fact that when it is less than 1.1 times, the difference of the resistances is so small and it is difficult to move the balance position X, while when it is more than 10 times, the deformation amount of the material is increased in the restriking from the fillet portion of a preliminary shape into the fillet portion of a predetermined shape, so that the shortage in the ductility of the material is caused to increase the possibility of causing cracks.

When a component of a preliminary shape is press-formed in the drawing method according to the aforementioned embodiment by making the bending radius in the shoulder portions of the punch 2 and/or the die member 4 larger than that of a component of a predetermined shape, the component of the preliminary shape is re-struck by bending or drawing to make the bending radius in the fillet portions P and/or the fillet portions D of the component smaller, whereby a component provided with fillet portions having a predetermined radius can be manufactured.

If a predetermined contour shape cannot be obtained by the drawing or the subsequent restriking, it is possible to manufacture a component having the predetermined contour shape by conducting a trimming for rendering the contour shape into the predetermined shape after or together with the restriking.

The balance position X can be determined by conducting an experiment of the drawing or a numerical analysis by a finite element method in the target component. Since the influence by the bending•unbending resistance is larger than the influence by the friction resistance or the shrinking resistance in the flange portion F, the shape of the component may be simply determined so that the bending•unbending resistance counterbalances at the vertical wall portion W or the flange portion F.

The bending•unbending resistance Fb can be calculated from the following formula using yield strength σe and thickness t of the material and bending radius R:

$$Fb=\sigma e\times t/(2*(0.5*t+R))$$

Figure 7:
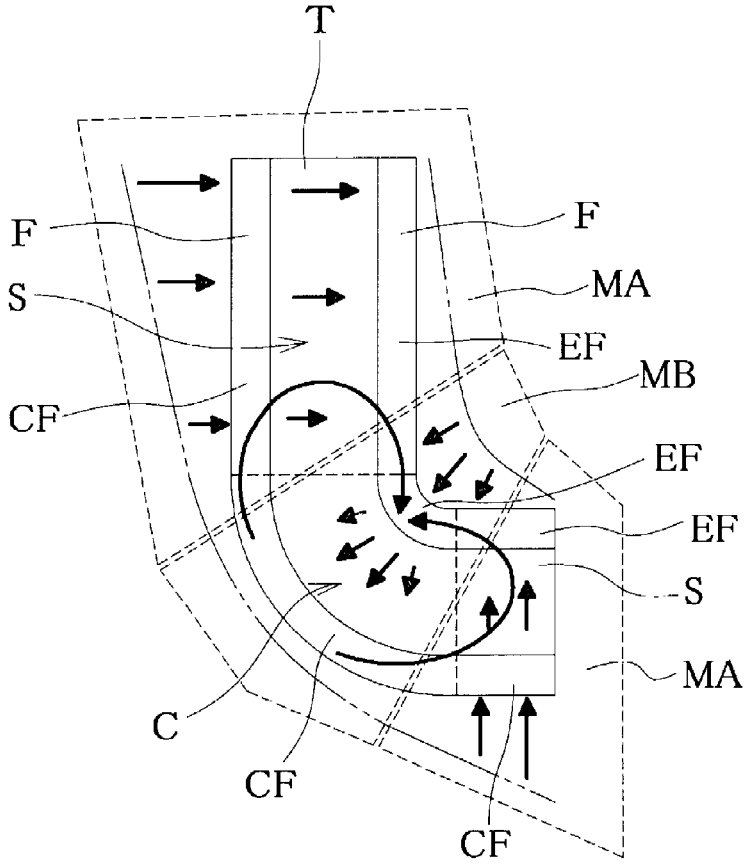
FIG. 7 is a plane view illustrating a material movement state in a drawing by the drawing method according to the above embodiment.

As a result of finding the above method for determining the balance position X, the inventors could find a method of generating an ideal material movement for suppressing one or both of the stretch flanging deformation and shrink flanging deformation as shown in FIG. 7

In this method, the material movement pattern MA is caused at least by determining the balance position X in the vertical wall portion W on the side of the stretch flanging deformation EF or in the fillet portion between the vertical wall W and the flange portion F at the straight side portions S connecting to the both ends of the curved portion C in the middle part of the vertical wall portion W curved in a widthwise direction of a component to be formed. Moreover, it is preferable that the material movement pattern MB is caused by determining the balance position X in the vertical wall portion W on the side of the shrink flanging deformation CF or in the fillet portion between the vertical wall portion W and the flange portion F at the curved portion C of the middle part.

In the usual drawing, when the material flowed from the flange portion F is suppressed, the forming at the shoulder portions of the punch 2 or the shoulder portions of the die member 4 becomes difficult. In this embodiment, however, the forming at the shoulder portions of the punch 2 and the shoulder portions of the die member 4 are mitigated because the material flowed from the top portion T is caused.

In the material movement pattern MA, since the material movement is increased in the flange portion F, the vertical wall portion W, and the punch shoulder fillet portion P on the side of shrink flanging deformation CF shown on the left side of FIG. 7, tensile deformation is caused in the flange portion F on the side of the shrink flanging deformation CF of the curved portion C shown on the left side of FIG. 7. On the contrary, the material movement from the flange portion F on the side of the stretch flanging deformation EF shown on the right side of FIG. 7 is decreased in the material movement pattern MA, so that the flange portion F on the side of the stretch flanging deformation EF is hardly stretched in the curved portion C shown on the right side of FIG. 7.

In the material movement pattern MB, the material in the flange portion F, the vertical wall portion W, and the top portion T on the side of the stretch flanging deformation EF shown on the right side of FIG. 7 are largely moved toward the side of the shrink flanging deformation CF shown on the left side of FIG. 7 while drawing the material in the circumferential direction along with the curving shape of the curved portion C, and hence the stretch flanging deformation is mitigated. Further, the material movement toward the flange portion F on the side of the shrink flanging portion CF is decreased, so that the occurrence of the shrink flanging deformation is suppressed.

According to the press-forming method of this embodiment, not only a component having a hat-shaped cross section and curved in a widthwise direction but also a component having a U-shaped cross section and curved in a widthwise direction can be formed by using all the material located in the flange portion F for forming the vertical wall portion W.

It is preferable that a metal sheet as a raw material for the blank has a tensile strength of 440-1470 MPa. Since a metal sheet having a tensile strength of less than 440 MPa is excellent in the ductility and drawability, it is less in the merit using the drawing method of this embodiment. On the other hand, since a metal sheet having a tensile strength exceeding 1470 MPa is poor in the ductility, cracks are easily caused at the shoulder portions of the punch 2 and/or the shoulder portions of the die member 4 which are not targeted in the drawing method of this embodiment, so that the drawing of the component may be difficult.

Table 1 shows various specifications of steel sheets of 270, 440, 980, 1180, and 1470 MPa grade. Table 2 shows results examined on comparative examples of the conventional method and examples of the method according to this embodiment in components having a hat-shaped cross section shown in FIGS. 1-3 made by using steel sheets of 270, 440, 980, 1180, and 1470 MPa grades as a sample material.

In order to change the balance position X, the radius of the fillet portion is set to a value as shown in Table 3 at the curved portion C and in Table 4 at the straight side portions S connecting to the curved portion, respectively. Here, the radius of the fillet portion in the punch shoulder and the die shoulder is R1 and R3 on the side near to the shrink flanging deformation CF, and R2 and R4 on the side near to the stretch flanging deformation EF, respectively. A round bead having a bending radius of 8 mm is used as a bead.

Figure 8:
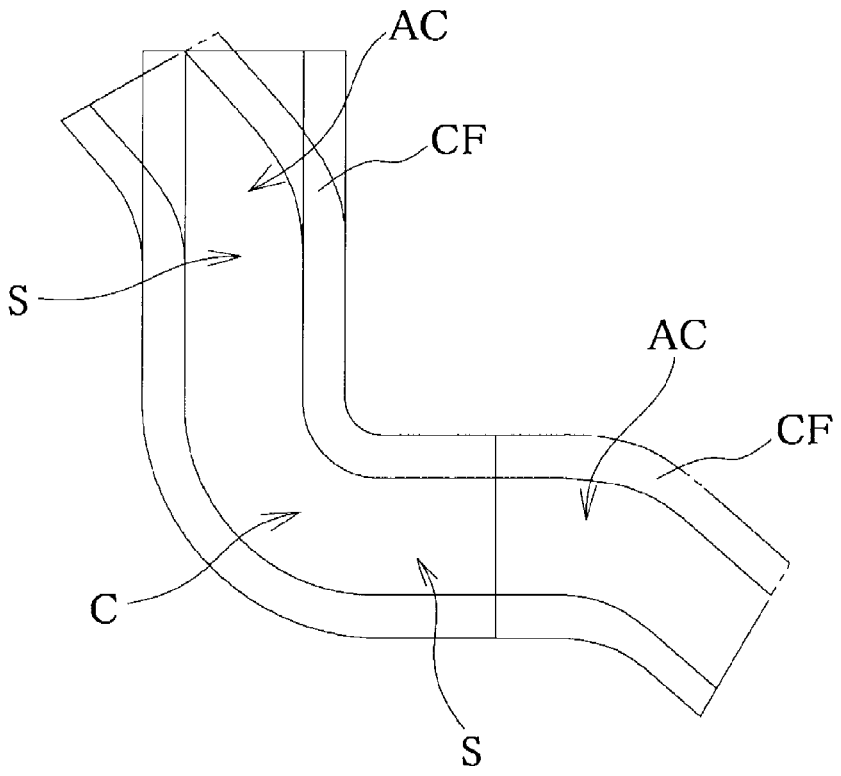
FIG. 8 is a plane view illustrating a shape of a component causing a material movement pattern MA in a drawing by the drawing method according to the above embodiment.

When the material movement pattern MA is caused by using the shrink flanging deformation CF in the above examination, there is used a shape of a component wherein additional curved portions AC causing shrink flange deformation CF are further connected to the straight side portions S as shown in FIG. 8. In this example, a vertical wall of the additional curved portion AC causing the shrink flanging deformation CF has a curved shape having a bending radius of 200 mm. However, a shape causing the material movement pattern MA is not particularly limited to the above shape.

TABLE 1

| Symbol | Steel type | Thickness (mm) | YP (MPa) | TS (MPa) | El (%) |
|---|---|---|---|---|---|
| 270 | 270 MPa grade steel sheet | 0.7 | 160 | 293 | 50 |
| 440 | 440 MPa grade steel sheet | 1.2 | 310 | 465 | 38 |
| 980 | 980 MPa grade steel sheet | 1.4 | 650 | 985 | 16 |
| 1180 | 1180 MPa grade steel sheet | 1.6 | 950 | 1200 | 10 |
| 1470 | 1470 MPa grade steel sheet | 1.6 | 1290 | 1520 | 8 |

TABLE 3

| Balance position X | R3 | R1 | R2 | R4 | Bead | Additional curved portion AC |
|---|---|---|---|---|---|---|
| Top portion | 5 | 5 | 5 | 5 | Absence | Absence |
| Vertical wall on shrink flanging side | 5 | 5.5 | 5.5 | 5 | Absence | Absence |
| Die shoulder on shrink flanging side | 5 | 50 | 40 | 20 | Absence | Presence |
| Flange on shrink flanging side | 10 | 20 | 20 | 10 | Presence (flange on shrink flanging side) | Absence |

TABLE 2

| Material | Balance position X: Curved portion C | Balance position X: Straight side portion S connecting to curved portion | Evaluation: Wrinkle | Evaluation: Crack | |
|---|---|---|---|---|---|
| 270 | Top portion | Top portion | ○ | ○ | Comparative Example |
| | Top portion | Flange on stretch flanging side | ○ | ○ | Comparative Example |
| 440 | Top portion | Top portion | X | X | Comparative Example |
| | Top portion | Flange on stretch flanging side | Δ | Δ | Comparative Example |
| | Vertical wall on shrink flanging side | Vertical wall on stretch flanging side | ○ | ○ | Inventive Example |
| | Vertical wall on shrink flanging side | Die shoulder on stretch flanging side | ○ | ○ | Inventive Example |
| | Vertical wall on shrink flanging side | Flange on stretch flanging side | ○ | ○ | Inventive Example |
| | Die shoulder on shrink flanging side | Vertical wall on stretch flanging side | ○ | ○ | Inventive Example |
| | Die shoulder on shrink flanging side | Die shoulder on stretch flanging side | ○ | ○ | Inventive Example |
| | Die shoulder on shrink flanging side | Flange on stretch flanging side | ○ | ○ | Inventive Example |
| | Flange on shrink flanging side | Vertical wall on stretch flanging side | ○ | ○ | Inventive Example |
| | Flange on shrink flanging side | Die shoulder on stretch flanging side | ○ | ○ | Inventive Example |
| | Flange on shrink flanging side | Flange on stretch flanging side | ○ | ○ | Inventive Example |
| 980 | Top portion | Top portion | X | X | Comparative Example |
| | Top portion | Flange on stretch flanging side | Δ | Δ | Comparative Example |
| | Vertical wall on shrink flanging side | Vertical wall on stretch flanging side | ○ | ○ | Inventive Example |
| | Vertical wall on shrink flanging side | Die shoulder on stretch flanging side | ○ | ○ | Inventive Example |
| | Vertical wall on shrink flanging side | Flange on stretch flanging side | ○ | ○ | Inventive Example |
| | Die shoulder on shrink flanging side | Vertical wall on stretch flanging side | ○ | ○ | Inventive Example |
| | Die shoulder on shrink flanging side | Die shoulder on stretch flanging side | ○ | ○ | Inventive Example |
| | Die shoulder on shrink flanging side | Flange on stretch flanging side | ○ | ○ | Inventive Example |
| | Flange on shrink flanging side | Vertical wall on stretch flanging side | ○ | ○ | Inventive Example |
| | Flange on shrink flanging side | Die shoulder on stretch flanging side | ○ | ○ | Inventive Example |
| | Flange on shrink flanging side | Flange on stretch flanging side | ○ | ○ | Inventive Example |
| 1180 | Top portion | Top portion | X | X | Comparative Example |
| | Top portion | Flange on stretch flanging side | Δ | Δ | Comparative Example |
| | Vertical wall on shrink flanging side | Vertical wall on stretch flanging side | ○ | ○ | Inventive Example |
| | Vertical wall on shrink flanging side | Die shoulder on stretch flanging side | ○ | ○ | Inventive Example |
| | Vertical wall on shrink flanging side | Flange on stretch flanging side | ○ | ○ | Inventive Example |
| | Die shoulder on shrink flanging side | Vertical wall on stretch flanging side | ○ | ○ | Inventive Example |
| | Die shoulder on shrink flanging side | Die shoulder on stretch flanging side | ○ | ○ | Inventive Example |
| | Die shoulder on shrink flanging side | Flange on stretch flanging side | ○ | ○ | Inventive Example |
| | Flange on shrink flanging side | Vertical wall on stretch flanging side | ○ | ○ | Inventive Example |
| | Flange on shrink flanging side | Die shoulder on stretch flanging side | ○ | ○ | Inventive Example |
| | Flange on shrink flanging side | Flange on stretch flanging side | ○ | ○ | Inventive Example |
| 1470 | Top portion | Top portion | X | X | Comparative Example |
| | Top portion | Flange on stretch flanging side | Δ | Δ | Comparative Example |
| | Vertical wall on shrink flanging side | Vertical wall on stretch flanging side | ○ | ○ | Inventive Example |
| | Vertical wall on shrink flanging side | Die shoulder on stretch flanging side | ○ | ○ | Inventive Example |
| | Vertical wall on shrink flanging side | Flange on stretch flanging side | ○ | ○ | Inventive Example |
| | Die shoulder on shrink flanging side | Vertical wall on stretch flanging side | ○ | ○ | Inventive Example |
| | Die shoulder on shrink flanging side | Die shoulder on stretch flanging side | ○ | ○ | Inventive Example |
| | Die shoulder on shrink flanging side | Flange on stretch flanging side | ○ | ○ | Inventive Example |
| | Flange on shrink flanging side | Vertical wall on stretch flanging side | ○ | ○ | Inventive Example |
| | Flange on shrink flanging side | Die shoulder on stretch flanging side | ○ | ○ | Inventive Example |
| | Flange on shrink flanging side | Flange on stretch flanging side | ○ | ○ | Inventive Example |

TABLE 4

| Balance position X | R3 | R1 | R2 | R4 | Bead | Additional curved portion AC |
|---|---|---|---|---|---|---|
| Top portion | 5 | 5 | 5 | 5 | Absence | Absence |
| Vertical wall on stretch flanging side | 20 | 30 | 30 | 5 | Absence | Absence |
| Die shoulder on stretch flanging side | 30 | 50 | 50 | 5 | Absence | Presence |
| Flange on stretch flanging side | 10 | 30 | 30 | 10 | Presence (flange on stretch flanging side) | Absence |

The conventional method is a usual drawing wherein the balance position X is on the top portion T. The evaluation of the formed products is performed visually wherein winkles and cracks generated in the flange portion are evaluated by three stages ○, Δ and x based on standards shown in Table 5 and Table 6, respectively.

TABLE 5

| Visual judgement on winkles |
|---|
| ○ No wrinkle |
| Δ Wrinkles generated in a portion other than an evaluated portion such as top portion |
| X Wrinkles |

TABLE 6

| Visual judgement on cracks | |
|---|---|
| ○ | No crack |
| Δ | Some cracking |
| X | Cracks |

As a result of the above examination, the 270 MPa grade steel sheet can be formed without generating wrinkles or cracks by either one of the conventional drawing method and the drawing method according to this embodiment. In the case of using the steel sheets of not less than 440 MPa, predominant cracks and wrinkles are generated in the conventional drawing method, whereas the generation of cracks and wrinkles can be prevented in the drawing method according to this embodiment.

Although the above is described with reference to the illustrated examples, the invention is not limited to the above examples and can be properly changed within a scope disclosed in the claims. For example, the die set used in the drawing may have a structure that the right and left shoulder portions and the concave portion of the die member 4 are made of different members instead of the structure shown in FIG. 4, or the drawing may be conducted by making the bending radius of the shoulder portions in the punch 2 so as to connect the upper end parts of the left and right fillet portions P to the curved top portion T.

INDUSTRIAL APPLICABILITY

According to the press-forming method of the invention, the method of manufacturing a component by using the press-forming method, and the component manufactured by using the press-forming method, when a component having a hat-shaped or U-shaped cross section and comprising a curved portion curved in a widthwise direction along with a longitudinal direction and straight side portions connecting to the both ends of the curved portion is press-formed from a sheet-shaped blank, the drawing is performed so as to have a hat-shaped or U-shaped cross section through a hat-shaped cross-sectional form comprising a top portion, vertical wall portions connecting at their upper end parts to both end parts of the top portion through fillet portions and flange portions connecting at their internal end parts thereof to the lower end parts of the vertical wall portions through fillet portions, and the material movement toward the flange portions of the curved portion is caused in the drawing to mitigate tensile deformation in the circumferential direction or compression deformation in the circumferential direction generated in the flange portion of the curved portion, whereby one or both of the generation of winkles due to the shrink flanging deformation and the generation of cracks due to the stretch flanging deformation can be suppressed.

DESCRIPTION OF REFERENCE SYMBOLS

1 blank holder
2 punch
3 lower die
4 die member
5 upper die
6 cushion pin
C curved portion
CF shrink flanging deformation
D die shoulder fillet portion
EF stretch flanging deformation
F flange portion
P punch shoulder fillet portion
R1-R4 bending radius
S straight side portion
T top portion
W vertical wall portion
X balance position

The invention claimed is:

1. A method for press-forming a component from a sheet-shaped blank, the component having a hat-shaped or U-shaped cross section and comprising a curved portion curved in a widthwise direction and straight side portions connecting to both ends of the curved portion, the method comprising:

drawing the blank through a hat-shaped cross-sectional form having a top portion, vertical wall portions connecting at their upper end parts to both end parts of the top portion through fillet portions, and flange portions connecting at their internal end parts to lower end parts of the vertical wall portions through fillet portions, wherein a material movement in the flange portion of the curved portion is caused in the drawing to mitigate tensile deformation or compression deformation in a circumferential direction generated in the flange portion of the curved portion compared with a case of moving the material to the vertical wall portion preferentially from the flange portion than from the top portion, by moving a balance position of flow of the material from the top portion toward the vertical wall portion in the straight side portion and/or in the curved portion.

2. The press-forming method according to claim 1, wherein the material movement is caused by setting the balance position of the material flowed in each of the straight side portions to either the vertical wall portion on the side of stretch flanging deformation in the curved portion or to the fillet portion between the vertical wall portion and the flange portion on the side of the stretch flanging deformation, and increasing the material flowed from the side of shrink flanging deformation in the straight side portion to an extent exceeding the top portion.

3. The press-forming method according to claim 1, wherein the material movement is caused by setting the balance position of the material flowed in the curved portion either to the vertical wall portion on the side of shrink flanging deformation or to the fillet portion between the vertical wall portion and the flange portion, and suppressing the material flowed from the side of the shrink flanging portion in the curved portion and increasing the material flowed from the side of stretch flanging deformation to an extent exceeding the top portion.

4. The press-forming method according to claim 1, wherein a bending radius of the fillet portion between the top portion and the vertical wall portion is set to 1.1-10 times of a bending radius of the fillet portion between the vertical wall portion and the flange portion in the cross section.

5. The press-forming method according to claim 1, wherein a bending radius of a fillet portion farther from the balance position is made larger than a bending radius of a fillet portion near to the balance position among the fillet portions between the top portion and the vertical wall portions in the cross section.

6. The press-forming method according to claim 2, wherein the material movement is also caused by setting the balance position of the material flowed in the curved portion either to the vertical wall portion on the side of the shrink flanging deformation or to the fillet portion between the vertical wall portion and the flange portion, and suppressing the material flowed from the side of the shrink flanging portion in the curved portion and increasing the material flowed from the side of the stretch flanging deformation to an extent exceeding the top portion.

7. The press-forming method according to claim 2, wherein a bending radius of the fillet portion between the top portion and the vertical wall portion is set to 1.1-10 times of a bending radius of the fillet portion between the vertical wall portion and the flange portion in the cross section.

8. The press-forming method according to claim 3, wherein a bending radius of the fillet portion between the top portion and the vertical wall portion is set to 1.1-10 times of a bending radius of the fillet portion between the vertical wall portion and the flange portion in the cross section.

9. The press-forming method according to claim 2, wherein a bending radius of a fillet portion farther from the balance position is made larger than a bending radius of a fillet portion near to the balance position among the fillet portions between the top portion and the vertical wall portions in the cross section.

10. The press-forming method according to claim 3, wherein a bending radius of a fillet portion farther from the balance position is made larger than a bending radius of a fillet portion near to the balance position among the fillet portions between the top portion and the vertical wall portions in the cross section.

11. The press-forming method according to claim 2, wherein the flange portion is provided at a side near to the balance position in the cross section with beads.

12. The press-forming method according to claim 3, wherein the flange portion is provided at a side near to the balance position in the cross section with beads.

13. The press-forming method according to claim 2, wherein the vertical wall portion has a curved shape at a side near to the balance position in the cross section.

14. The press-forming method according to claim 3, wherein the vertical wall portion has a curved shape at a side near to the balance position in the cross section.

15. The press-forming method according to claim 2, wherein a metal sheet having a tensile strength of 440-1470 MPa is used as the blank.

16. The press-forming method according to claim 3, wherein a metal sheet having a tensile strength of 440-1470 MPa is used as the blank.

17. The press-forming method according to claim 4, wherein a metal sheet having a tensile strength of 440-1470 MPa is used as the blank.

18. The press-forming method according to claim 5, wherein a metal sheet having a tensile strength of 440-1470 MPa is used as the blank.

19. A method of manufacturing a component, wherein a sheet-shaped blank is drawn into a component of a preliminary shape having a hat-shaped and curved in a widthwise direction by using the press-forming method as claimed in claim 1 and the component of the preliminary shape is subjected to at least one of a restriking for rendering a bending radius of the fillet portions into a predetermined radius and a trimming for rendering a contour shape thereof into a predetermined shape to manufacture a component having a hat-shaped or U-shaped cross section and curved in a widthwise direction.

20. A formed component having a hat-shaped or U-shaped cross section and curved in a widthwise direction, wherein the component is formed by drawing from a sheet-shaped blank by using the press-forming method as claimed in claim 1 and formed into a predetermined shape by using at least one of a restriking for rendering a bending radius of the fillet portions into a predetermined radius and a trimming for rendering a contour shape thereof.

21. A method for press-forming a component from a sheet-shaped blank, the component having a hat-shaped or U-shaped cross section and comprising a curved portion curved in a widthwise direction and straight side portions connecting to both ends of the curved portion, the method comprising:

drawing the blank through a hat-shaped cross-sectional form having a top portion, vertical wall portions connecting at their upper end parts to both end parts of the top portion through fillet portions, and flange portions connecting at their internal end parts to lower end parts of the vertical wall portions through fillet portions, wherein a material movement in the flange portion of the curved portion is caused by setting a balance position of the material flowed in each of the straight side portions to either the vertical wall portion on the side of stretch flanging deformation in the curved portion or to the fillet portion between the vertical wall portion and the flange portion on the side of the stretch flanging deformation, and increasing the material flowed from the side of shrink flanging deformation in the straight side portion to an extent exceeding the top portion.

22. A method for press-forming a component from a sheet-shaped blank, the component having a hat-shaped or U-shaped cross section and comprising a curved portion curved in a widthwise direction and straight side portions connecting to both ends of the curved portion, the method comprising:

drawing the blank through a hat-shaped cross-sectional form having a top portion, vertical wall portions connecting at their upper end parts to both end parts of the top portion through fillet portions, and flange portions connecting at their internal end parts to lower end parts of the vertical wall portions through fillet portions, wherein a material movement in the flange portion of the curved portion is caused by setting a balance position of the material flowed in the curved portion either to the vertical wall portion on the side of shrink flanging deformation or to the fillet portion between the vertical wall portion and the flange portion, and suppressing the material flowed from the side of the shrink flanging portion in the curved portion and increasing the material flowed from the side of stretch flanging deformation to an extent exceeding the top portion.

* * * * *